US006955038B2

(12) United States Patent
McCaffrey et al.

(10) Patent No.: US 6,955,038 B2
(45) Date of Patent: Oct. 18, 2005

(54) METHODS AND APPARATUS FOR OPERATING GAS TURBINE ENGINE COMBUSTORS

(75) Inventors: Timothy P. McCaffrey, Swampscott, MA (US); Stephen John Howell, West Newbury, MA (US); Walter J. Tingle, Danvers, MA (US); Barry Francis Barnes, Milford, CT (US); John Carl Jacobson, Melrose, MA (US)

(73) Assignee: General Electric Company, Schenectady, NY (US)

( * ) Notice: Subject to any disclaimer, the term of this patent is extended or adjusted under 35 U.S.C. 154(b) by 169 days.

(21) Appl. No.: 10/613,581

(22) Filed: Jul. 2, 2003

(65) Prior Publication Data

US 2005/0000226 A1 Jan. 6, 2005

(51) Int. Cl.[7] ..... F02C 7/18; F02C 7/22
(52) U.S. Cl. ..... 60/39.094; 60/39.83; 60/740
(58) Field of Search ..... 60/39.83, 39.094, 60/740, 806; 431/160

(56) References Cited

U.S. PATENT DOCUMENTS 4,216,908 A * 8/1980 Sakurai et al. ..... 239/132.3
4,858,538 A * 8/1989 Kuypers et al. ..... 239/132.3
4,950,129 A 8/1990 Patel et al.
5,222,360 A 6/1993 Antuna et al.
5,228,828 A 7/1993 Damlis et al.
5,273,396 A 12/1993 Albrecht et al.
5,281,085 A 1/1994 Lenahan et al.
5,820,024 A 10/1998 Ausdenmoore et al.
5,911,679 A 6/1999 Farrell et al.
6,045,325 A 4/2000 Horvath et al.
6,073,436 A * 6/2000 Bell et al. ..... 60/39.094
6,438,963 B1 * 8/2002 Traver et al. ..... 60/39.094
2002/0073707 A1 * 6/2002 Lavie et al. ..... 60/740

* cited by examiner

*Primary Examiner*—Louis J. Casaregola
(74) *Attorney, Agent, or Firm*—Armstrong Teasdale LLP; William Scott Andes

(57) ABSTRACT

A method facilitates assembling a gas turbine engine. The method comprises coupling a combustor including a dome assembly and a combustor liner that extends downstream from the dome assembly to a combustor casing that is positioned radially outwardly from the combustor, coupling a fuel injector including a fuel inlet and an air inlet to the combustor casing such that the fuel injector extends axially through the dome assembly such that fuel may be discharged from the primer nozzle into the combustor, and coupling the air inlet to an air source such that cooling air received therethrough is circulated through the fuel injector to facilitate cooling the fuel injector.

6 Claims, 3 Drawing Sheets

METHODS AND APPARATUS FOR OPERATING GAS TURBINE ENGINE COMBUSTORS

STATEMENT REGARDING FEDERALLY SPONSORED RESEARCH OR DEVELOPMENT

The U.S. Government may have certain rights in this invention pursuant to contract number DAAE07-00-C-N086.

BACKGROUND OF THE INVENTION

This invention relates generally to gas turbine engines, more particularly to combustors used with gas turbine engines.

Known turbine engines include a compressor for compressing air which is suitably mixed with a fuel and channeled to a combustor wherein the mixture is ignited for generating hot combustion gases. The gases are channeled to at least one turbine, which extracts energy from the combustion gases for powering the compressor, as well as for producing useful work, such as propelling a vehicle.

To support engine casings and components within harsh engine environments, at least some known casings and components are supported by a plurality of support rings that are coupled together to form a backbone frame. The backbone frame provides structural support for components that are positioned radially inwardly from the backbone and also provides a means for an engine casing to be coupled around the engine. In addition, because the backbone frame facilitates controlling engine clearance closures defined between the engine casing and components positioned radially inwardly from the backbone frame, such backbone frames are typically designed to be as stiff as possible. At least some known backbone frames used with recuperated engines, include a plurality of beams that extend between forward and aft flanges.

Because of exposure to high temperatures generated within the combustor, fuel injectors used with such engines require cooling. Accordingly, at least some known fuel injectors are cooled by fuel flowing through the fuel injector, as well as through the use of passive "dead air" insulation areas defined internally within the fuel injector. Moreover, to facilitate efficient operation of the fuel injectors, at least some known fuel injectors are designed to enable residual fuel to be forced out of the fuel injector and into an overboard drain during pre-determined combustor operations. In addition, an overall size of the fuel injectors is limited by combustor space limitations. Accordingly, designing an efficient fuel injector for use with such engines may be difficult.

BRIEF DESCRIPTION OF THE INVENTION

In one aspect, a method for assembling a gas turbine engine is provided. The method comprises coupling a combustor including a dome assembly and a combustor liner that extends downstream from the dome assembly to a combustor casing that is positioned radially outwardly from the combustor, coupling a fuel injector including a fuel inlet and an air inlet to the combustor casing such that the fuel injector extends axially through the dome assembly such that fuel may be discharged from the fuel injector into the combustor, and coupling the air inlet to an air source such that cooling air received therethrough is circulated through the fuel injector to facilitate cooling the fuel injector.

In another aspect, a fuel injector for a gas turbine engine combustor including a centerline axis is provided. The fuel injector comprises a fuel inlet, an injection tip, and a body. The injection tip is discharging fuel into the combustor in a direction that is substantially parallel to the gas turbine engine centerline axis. The body extends between the inlet and the injection tip. The body comprises at least one air inlet and at least one air outlet. The inlet is for receiving cooling air within the body, and the outlet is for discharging cooling air external to the combustor case.

In a further aspect, a combustion system for a gas turbine engine is provided. The combustion system comprises a combustor, a combustor casing, and a fuel injector. The combustor includes a dome assembly and a combustor liner that extends downstream from the dome assembly. The combustor liner defines a combustion chamber therein. The combustor also includes a centerline axis. The combustor casing extends around the combustor. The fuel injector extends through the combustor casing and the dome assembly, and includes a fuel inlet, an injection tip, and a body extending between the fuel inlet and the injection tip. The injection tip is for discharging fuel into the combustor. The body includes at least one air inlet and at least one air outlet. The inlet is for receiving cooling air within the body. The outlet is for discharging cooling air external to the combustor case.

DETAILED DESCRIPTION OF THE INVENTION

Figure 1:
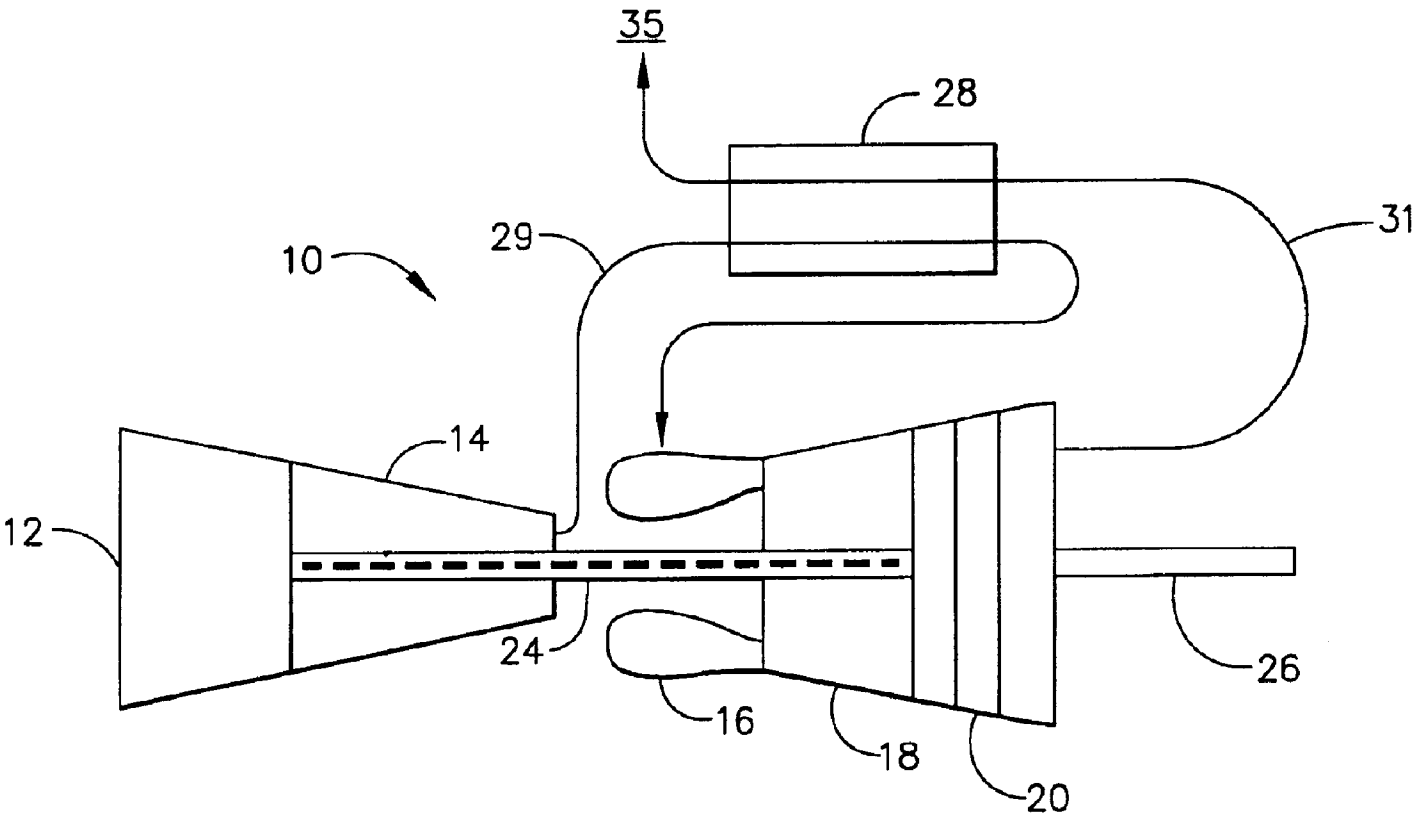
FIG. 1 is a schematic of a gas turbine engine.

FIG. 1 is a schematic illustration of a gas turbine engine 10 including a high pressure compressor 14, and a combustor 16. Engine 10 also includes a high pressure turbine 18 and a low pressure turbine 20. Compressor 14 and turbine 18 are coupled by a first shaft 24, and turbine 20 drives a second output shaft 26. Shaft 26 provides a rotary motive force to drive a driven machine, such as, but, not limited to a gearbox, a transmission, a generator, a fan, or a pump. Engine 10 also includes a recuperator 28 that has a first fluid path 29 coupled serially between compressor 14 and combustor 16, and a second fluid path 31 that is serially coupled between turbine 20 and ambient 35. In one embodiment, the gas turbine engine is an LV100 available from General Electric Company, Cincinnati, Ohio. In an alternative embodiment, engine 10 includes a low pressure compressor 12 coupled by a first shaft 24 to turbine 20, and compressor 14 and turbine 18 are coupled by a second shaft 26.

In operation, air flows through high pressure compressor 14. The highly compressed air is delivered to recuperator 28 where hot exhaust gases from turbine 20 transfer heat to the compressed air. The heated compressed air is delivered to combustor 16. Airflow from combustor 16 drives turbines 18 and 20 and passes through recuperator 28 before exiting gas turbine engine 10. In an alternative embodiment, during operation, air flows through low pressure compressor 12 and compressed air is supplied from low pressure compressor 12 to high pressure compressor 14. The highly compressed air is delivered to combustor 16. Airflow from combustor 16 drives turbines 18 and 20 before exiting gas turbine engine 10.

Figure 2:
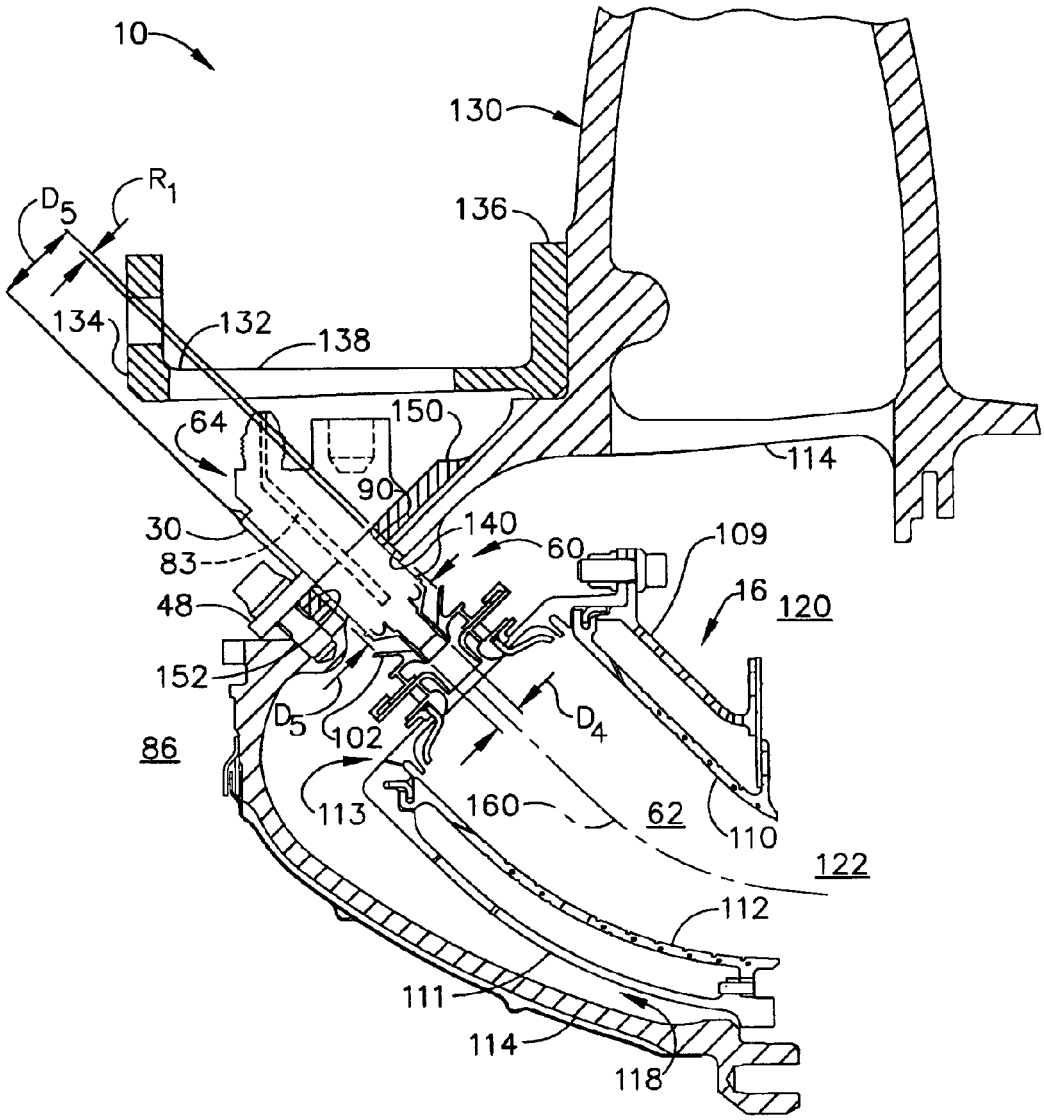
FIG. 2 is a cross-sectional illustration of a portion of the gas turbine engine shown in FIG. 1.
Figure 4:
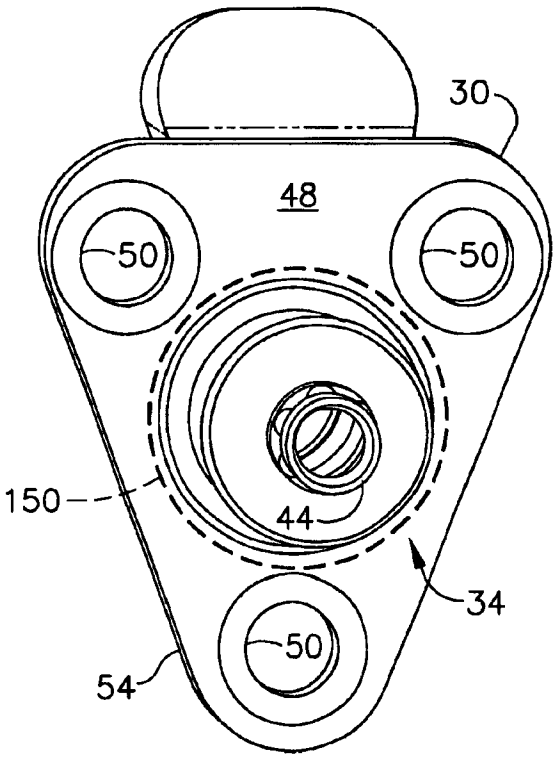
FIG. 4 is a plan view of the fuel injector shown in FIG. 3 and viewed from a downstream side of the fuel injector.
Figure 3:
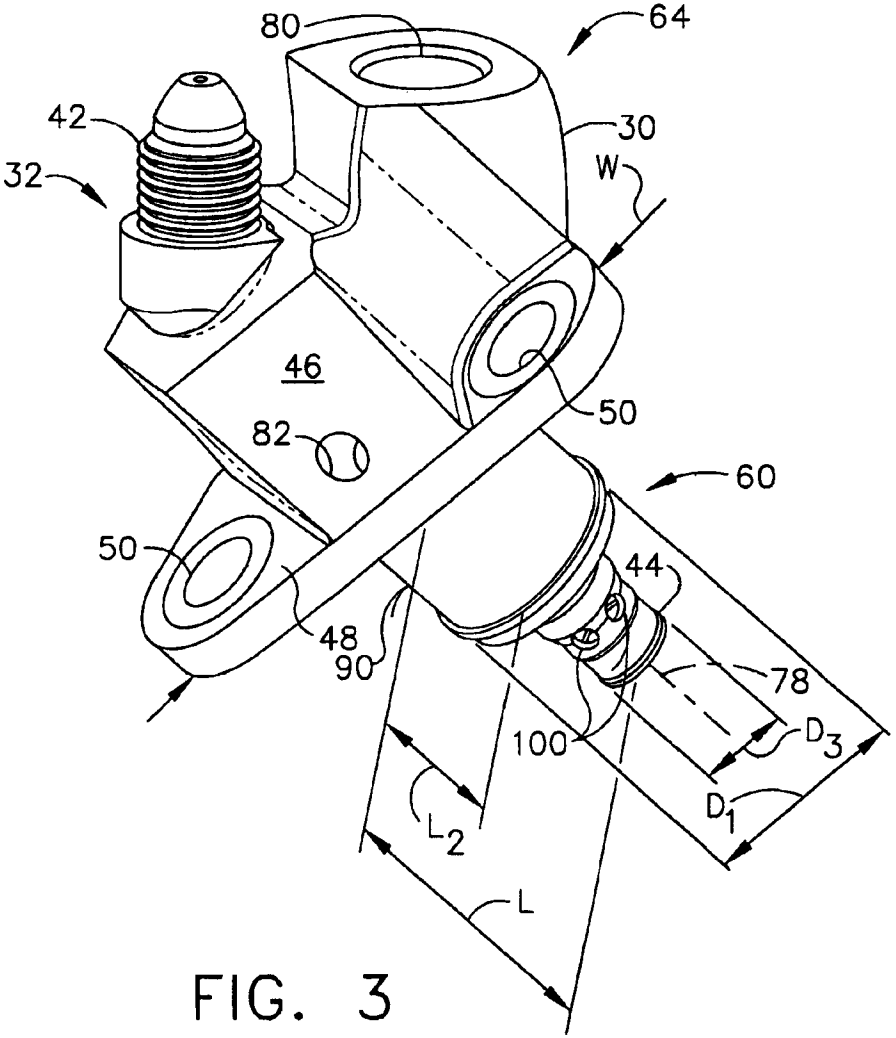
FIG. 3 is an enlarged perspective view of a fuel injector used with the gas turbine engine shown in FIG. 2 and taken from an upstream side of the fuel injector.

FIG. 2 is a cross-sectional illustration of a portion of gas turbine engine 10 including a fuel injector 30. FIG. 3 is an enlarged perspective view of fuel injector 30 viewed from an upstream side 32 of fuel injector 30. FIG. 4 is a plan view of fuel injector shown in FIG. 3 and viewed from a downstream side 34 of fuel injector 30. In the exemplary embodiment, fuel injector 30 includes a fuel inlet 42, an injection tip 44, and a body 46 that extends therebetween. Fuel inlet 42 coupled to a fuel supply source for channeling fuel into fuel injector 30, as is described in more detail below. In addition, inlet 42 is also coupled in flow communication to an air source for channeling air flow through fuel injector 30 to facilitate purging residual fuel from fuel injector 30 during pre-determined combustor operations when fuel flow to fuel injector 30 has ceased. In one embodiment, inlet 42 is coupled to the air source through an accumulator (not shown).

In the exemplary embodiment, injector body 46 includes an annular shoulder 48 that extends radially outward from body 46. Shoulder 48 facilitates positioning fuel injector 30 in proper orientation and alignment with respect to combustor 16 when fuel injector 30 is coupled within engine 10, as described in more detail below. More specifically, injector shoulder 48 includes a plurality of openings 50 extending therethrough. Openings 50 are each sized to receive a fastener 52 therethrough (not shown) used to couple fuel injector 30 to combustor 16. In the exemplary embodiment, injector 30 includes three openings 50 that are sized identically, and are each positioned adjacent an outer perimeter 54 of fuel injector shoulder 48.

Shoulder 48 is substantially planar and separates fuel injection body 46 into an internal portion 60 that is extended into combustor 16, and is thus exposed to a combustion primary zone or combustion chamber 62 defined within combustor 16, and an external portion 64 that extends externally from combustor 16. More specifically, when fuel injector 30 is coupled to combustor 16, shoulder 48 prevents fuel injector external portion 64 from entering combustor 16. Accordingly, a length L of internal portion 60 is variably selected to facilitate limiting the depth of insertion of injector 30 and thus limits the amount of injector 30 exposed to radiant heat generated within combustion primary zone 62. More specifically, the combination of internal portion length L and relative position of shoulder 48 with respect to injector body 46 facilitates orienting fuel injection tip 44 in position within combustor 16.

Fuel inlet 42 extends outwardly from fuel injector external portion 64. More specifically, inlet 42 is obliquely oriented with respect to a centerline axis 78 extending through injection tip 44 and body 46. In the exemplary embodiment, fuel inlet 42 is threaded to facilitate coupling inlet 42 to a fuel source. In addition, fuel injector external portion 64 also includes an air inlet 80 and at least one air vent 82. Moreover, fuel injector external portion 64 includes at least one cooling cavity (not shown) defined therein. Fuel entering fuel inlet 42 is channeled through a passageway 83 extending from fuel inlet 42 through the cooling cavity to fuel injector internal portion 60.

Air inlet 80 and each air vent 82 are coupled in flow communication with an air source for receiving cooling air therethrough. More specifically, in the exemplary embodiment, inlet 80 and vent 82 receive unrecuperated air therethrough. In one embodiment, inlet 80 and 82 receive unrecuperated intercompressor air which is at an operating temperature that is much less than an operating temperature of recuperated air. Cooling air entering air inlet 80 is oriented obliquely with respect to centerline axis 78 and is channeled through each cooling cavity, and around the fuel passageway before being discharged from fuel injector 30 through vents 82. As described in more detail below, spent cooling air discharged from vents 82 is discharged into the engine bay 86 rather than being discharged into combustor 16. In addition, the cooling air entering air inlet 80 also facilitates preventing over-heating of fuel injector 30 and fuel coking within fuel injector 30.

A shroud 90 circumscribes a portion of fuel injector internal portion 60 to facilitate shielding injection tip 44 and a portion of internal portion 60 from heat generated within combustion primary zone 62. In the exemplary embodiment, shroud 90 is substantially circular. Specifically, shroud 90 has a length $L_2$ that is shorter than fuel injector internal portion length L, and a diameter $D_1$ that is larger than a diameter (not shown) of fuel injector internal portion 60.

Tip 44 includes a plurality of cooling openings 100 that extend through tip 44 and are in flow communication with injection tip 44 and air supplied to combustor 16 to facilitate atomization and spray control of fuel discharged from fuel injector 30. In the exemplary embodiment, the air supplied to combustor 16 to facilitate atomization and spray control is recuperated, high pressure air that has been circulated through a recuperation cycle which adds exhaust gas heat into compressor discharge air. More specifically, in the exemplary embodiment, tip 44 is substantially circular, and openings 100 are circumferentially-spaced around tip 44.

Shroud 90 extends from shoulder 48 to fuel injection tip 44. Tip 44 is substantially concentrically aligned with respect to shoulder 48 and has a diameter $D_3$ that is less than shroud diameter $D_1$, and is variably selected to be sized approximately equal to an internal diameter $D_4$ of a combustor primary swirler 102. More specifically, because tip diameter $D_3$ is variably selected to be sized approximately equal to a swirler internal diameter $D_4$, when injector 30 is coupled to combustor 16, tip 44 circumferentially contacts primary swirler 102 to facilitate minimizing recuperating air leakage to combustion chamber 62 and between injector 30 and swirler 92.

Combustor 16 includes an outer support 109, an annular outer liner 110, an inner support 111, an annular inner liner 112, and a domed end 113 that extends between outer and inner liners 110 and 112, respectively. Outer liner 110 and inner liner 112 are spaced radially inward from a combustor casing 114 and define combustion chamber 62. Combustor casing 114 is generally annular and extends around combustor 16 and inner and outer supports, 109 and 111 respectively. Combustion chamber 62 is generally annular in shape and is radially inward from liners 110 and 112. Outer support 111 and combustor casing 114 define an outer passageway 118 and inner support 109 and combustor casing 114 define an inner passageway 120. Outer and inner liners 110 and 112 extend to a turbine nozzle 122.

A portion of combustor casing 114 forms a combustor backbone frame 130 that extends circumferentially around combustor 16 to provide structural support to combustor 16 within engine 10. An annular ring support 132 is coupled to combustor backbone frame 130. Ring support 132 includes an annular upstream radial flange 134, an annular downstream radial flange 136, and a plurality of circumferentially-spaced beams 138 that extend therebetween. In the exemplary embodiment, upstream and downstream flanges 134 and 136 are substantially circular and are substantially parallel. Specifically, ring support 132 extends axially between compressor 14 (shown in FIG. 1) and turbine 18 (shown in FIG. 1), and provides structural support between compressor 14 and turbine 18.

A portion of combustor casing 114 also forms an opening 140 that provides a coupling seat for fuel injector 30. Specifically, opening 140 has an inner diameter $D_5$ that is smaller than a width W of fuel injector shoulder 48, and is slightly larger than shroud diameter $D_1$. More specifically, shroud diameter $D_1$ is variably selected to allow enough space to enable a seal member 150 to be assembled, while facilitating reducing a radial distance $R_1$ between shroud 90 and an inner surface 152 defining casing opening 140. Reducing radial distance $R_1$ facilitates enhancing the effectiveness of seal member 150 to prevent recuperated air from escaping from combustor casing 114 past fuel injector 30.

Accordingly, when fuel injector 30 is inserted through combustor casing opening 140, fuel injector shoulder 48 contacts casing 114 and limits an insertion depth of fuel injector internal portion 60 with respect to combustor 16. More specifically, shoulder 48 facilitates positioning fuel injection tip 44 in proper orientation and alignment with respect to combustor 16 when fuel injector 30 is coupled to combustor 16.

During assembly of engine 10, after combustor 16 is secured in position with respect to combustor casing 114, fuel injector internal portion 60 is inserted through seal member 150 such that seal member 150 is deformed in sealing contact against shoulder 48. Fuel injector 30 is then inserted through casing opening 140 and is coupled in position with respect to combustor 16 using fasteners 52, such that seal member 150 is deformed in sealing contact between shoulder 48 and casing 114. In the exemplary embodiment, to facilitate assembly and disassembly fasteners are initially coated with a lubricant, such as Tiolube 614-19B, commercially available from TIODIZE®, Huntington Beach, Calif.

Ring support 132 is then coupled to combustor casing 114 such that fuel injector 30 is coupled in position within the space constraints defined between ring support 132 and casing 114.

Specifically, when fuel injector 30 is coupled to combustor casing 114, nozzle 30 extends outward to the ring support 132, and fuel injector shroud 90 and injection tip 44 extend substantially axially through domed end 113. Accordingly, the only access to combustion chamber 62 is through combustor domed end 113, such that if warranted, primer nozzle 30 may be replaced without disassembling combustor 16.

During operation, fuel and air are supplied to fuel injector 30. More specifically, fuel is supplied to fuel inlet 42, and unrecuperated cooling air is supplied to air inlet 80. The cooling air is circulated through injector body 46 prior to being discharged into engine bay 86. The combination of fuel and cooling air flowing through fuel injector 30 facilitates reducing an operating temperature of fuel injector 30.

Fuel discharged from fuel injector 30 is discharged with approximately a ninety-degree spray cone with respect to domed end 113 and along a centerline axis 160 extending from domed end 113 through combustor 16. More specifically, as the fuel is discharged, the fuel is mixed with recuperated air supplied to combustor 16 to facilitate atomization and spray control of fuel discharged from injector 30. Moreover, the direction of fuel injection facilitates reducing a time for fuel ignition within combustion chamber 62. Accordingly, fuel discharged from fuel injector 30 is discharged into combustion chamber 62 in a direction that is substantially parallel to centerline axis 160.

During pre-determined operations of combustor 16, fuel flow to fuel injectors 30 is stopped, which makes fuel injectors 30 susceptible to coking. To facilitate preventing coking within fuel injectors 30, injectors 30 are purged with unrecuperated air supplied at a high pressure such that residual fuel is expelled into combustor 16. Specifically, the operating temperature of the purge air is lower than an operating temperature of the recuperated air supplied to combustor 16 for fuel atomization. The purge air also facilitates reducing an operating temperature of fuel injector 30 and injection tip 44 during engine operations when fuel injector 30 is not employed.

The above-described combustion support provides a cost-effective and reliable means for supplying fuel to a combustor with a fuel injector. The fuel injector includes a fuel inlet that enables fuel to be discharged into the combustion chamber in a direction that is substantially parallel to the combustor centerline axis, and an air inlet that enables unrecuperated air to flow through the fuel injector to facilitate cooling the fuel injector. Spent internal cooling air is then discharged into the engine bay. The fuel injector also includes a shroud that facilitates shielding the fuel injector from high temperatures generated within the combustor. Accordingly, a fuel injector is provided which enables fuel to be supplied to a combustor in a cost-effective and reliable manner.

An exemplary embodiment of a combustion system is described above in detail. The combustion system components illustrated are not limited to the specific embodiments described herein, but rather, components of each combustion system may be utilized independently and separately from other components described herein. For example, each fuel injector may also be used in combination with other engine combustion systems.

While the invention has been described in terms of various specific embodiments, those skilled in the art will recognize that the invention can be practiced with modification within the spirit and scope of the claims.

What is claimed is:

1. A fuel injector for a gas turbine engine combustor including a centerline axis, said fuel injector comprising:

a fuel inlet coupled to a cooling air source;

an injection tip for discharging fuel into said combustor in a direction that is substantially parallel to the combustor centerline axis; and a body extending between said inlet and said injection tip, said body comprising at least one air inlet and at least one air outlet, said inlet for receiving cooling air within said body, said outlet for discharging cooling air external to the combustor.

2. A fuel injector in accordance with claim 1 further comprising a shroud extending around said injection tip, said tip supplied recuperated air for atomization of fuel discharged from said fuel injector.

3. A fuel injector in accordance with claim 1 wherein said at least one body air inlet is coupled in flow communication to an air source for receiving unrecuperated air for cooling said fuel injector.

4. A fuel injector in accordance with claim 1 wherein said body further comprises an annular shoulder extending radially outward therefrom, said shoulder comprising a plurality of openings extending therethrough, each said opening sized to receive a fastener therethrough for securing said fuel injector to the combustor.

5. A fuel injector in accordance with claim 1 wherein said body further comprises an annular shoulder extending radially outward therefrom, said shoulder facilitates orienting said fuel injector with respect to the combustor.

6. A fuel injector in accordance with claim 1 wherein said cooling air source is an accumulator and air from said accumulator purges residual fuel from said fuel injector into the combustor during pre-determined combustor operating conditions.

* * * * *